United States Patent [19]

Bradtmöller

[11] Patent Number: 4,475,897

[45] Date of Patent: Oct. 9, 1984

[54] METHOD OF AND APPARATUS FOR OPTIMIZING THE CLARIFIED PHASE AND CONCENTRATION OF SOLIDS IN A CONTINUOUS SOLIDS-DISCHARGE CENTRIFUGE

[75] Inventor: Werner Bradtmöller, Oelde, Fed. Rep. of Germany

[73] Assignee: Westfalia Separator AG, Oelde, Fed. Rep. of Germany

[21] Appl. No.: 514,755

[22] Filed: Jul. 18, 1983

[30] Foreign Application Priority Data

Jul. 28, 1982 [DE] Fed. Rep. of Germany ..... 3228074

[51] Int. Cl.[3] ..... B04B 11/00

[52] U.S. Cl. ..... 494/35; 494/10; 494/11

[58] Field of Search ..... 494/35, 1, 10, 11, 23, 494/27, 30, 37, 42, 22; 210/360.1, 369, 371

[56] References Cited

U.S. PATENT DOCUMENTS

| | | | |
|---|---|---|---|
| 2,532,792 | 12/1950 | Svensjo | 494/1 |
| 3,623,657 | 11/1971 | Trump | 494/35 |
| 3,750,940 | 8/1973 | Nilsson | 494/35 |
| 3,752,389 | 8/1973 | Nilsson | 494/35 |
| 3,893,907 | 7/1975 | Canevari | 494/35 |

*Primary Examiner*—Robert W. Jenkins

*Attorney, Agent, or Firm*—Sprung Horn Kramer & Woods

[57] ABSTRACT

In a centrifuge of the type in which the solids are continuously discharged through nozzles, the nozzles are dimensioned to ensure that the volume of solids discharged from them is smaller than the volume of solids fed into the centrifuge through a feed line. The solids space in the centrifuge accordingly fills up gradually and, when it is full, the clarified phase begins to get turbid. The level of turbidity is determined by a photocell and the flow of clarified phase returned to the feed line through a diversion valve. Since the amount of liquid being fed into the centrifuge is maintained at a constant level, the volume of new liquid flowing into the centrifuge is decreased by an amount equal to the volume of clarified phase being recirculated. The volume of solids being fed into the centrifuge then decreases to below the level of the volume of solids that can be discharged from the nozzles until the solids retained in the drum are discharged with the maximum concentration of solids discharged from the nozzles being maintained. Once the level of turbidity decreases, the recirculation of the clarified phase is, preferably after a certain delay, terminated. The method ensures a constant maximum concentration of solids discharge and optimum clarification of the liquid phase at minimum automatic-control costs.

5 Claims, 1 Drawing Figure

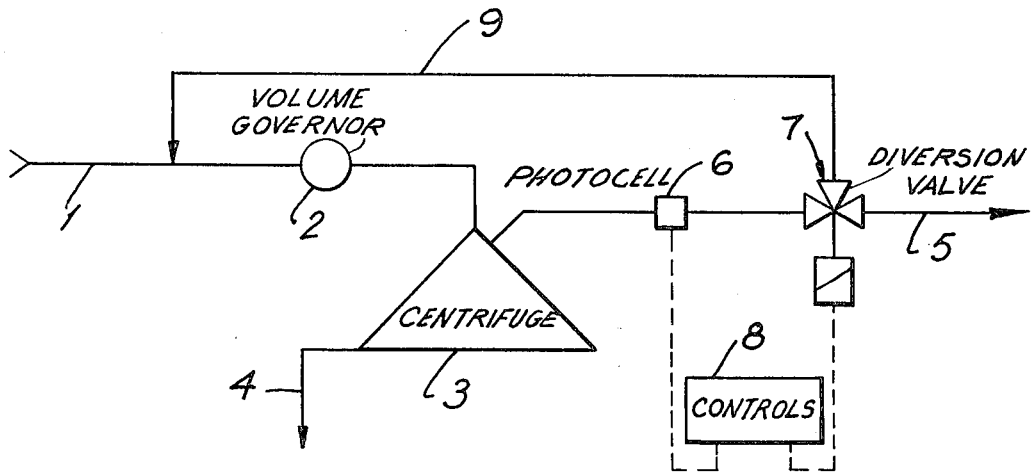
9
VOLUME
GOVERNOR
7
DIVERSION
VALVE
PHOTOCELL
6
1
2
5
CENTRIFUGE
8
4
3
CONTROLS

METHOD OF AND APPARATUS FOR OPTIMIZING THE CLARIFIED PHASE AND CONCENTRATION OF SOLIDS IN A CONTINUOUS SOLIDS-DISCHARGE CENTRIFUGE

BACKGROUND OF THE INVENTION

The invention relates to a method of and apparatus for optimizing the clarified phase and the concentration of solids in a continuous solids-discharge centrifuge in which nozzles maintain the volume of concentrate to be extracted from the drum at a constant level and in which a photocell monitors the discharging clarified phase.

A method in which a photocell monitors the turbidity of the clarified phase, the liquid is fed into the centrifuge at a rate that depends on the turbidity, and a viscosimeter continuously determines the concentration of the concentrate discharge, some of which is returned to the centrifuge in accordance with the results of the determination, is known from U.S. Pat. No. 2,532,792 for example.

This system involves the drawbacks of automatic controls, which are at any rate expensive to install and operate. Determination of the viscosity of a concentration of solids discharged through nozzles is falsified by contact with the air during extraction. Furthermore, the on-off system necessary in automatic controls yields neither the maximum possible concentration of solids nor the lowest possible concentration of solids in the clarified phase.

SUMMARY OF THE INVENTION

The object of the present invention is to provide a method of controlling the operation of a continuous solids-discharge centrifuge so that the solids discharge will always have the maximum possible concentration and the clarified phase will always have the lowest possible concentration of solids.

This object is achieved in accordance with the invention in a continuous solids-discharge centrifuge wherein the volume of liquid fed into the centrifuge is maintained at a constant level, the volume of solids that can be discharged from the nozzles is smaller than the minimum volume of solids in the feed line, and the clarified phase is, when it begins to get turbid and when the solids space is full, returned to the feed line until the solids space has emptied enough for turbidity to drop below the range determined by the photocell.

There are at first no solids in the solids space as separation commences. Since more solids are fed into the centrifuge in accordance with the invention than can be discharged from the nozzles on the drum, the solids space in the drum will gradually fill up. When the solids space is full, the clarified phase will begin to get turbid because it will entrain particles of the solids as it flows to the center of the drum. The photocell will detect this situation and immediately divert the clarified phase back into the feed line. Since the volume of liquid fed into the centrifuge is kept constant, however, the volume of new liquid entering the centrifuge will be decreased by an amount equal to the volume of the recirculated clarified phase. The volume of solids supplied to the drum will also be decreased in proportion to the decreased volume being fed in to a level below that of the volume being discharged from the nozzles. The excess solids retained in the drum will flow off without the solids being discharged from the nozzles losing their maximum possible concentration, and the turbidity of the clarified phase will decrease until it is no longer returned to circulation. The restoration of the clarified phase to the discharge line can be delayed with a timing device to make the excess solids flow off more effectively.

Another advantage of this method is the constant level of centrifuge throughput, which eliminates impact effects in the clarification zone of the drum. Furthermore, extremely simple continuous solids-discharge centrifuges can be built to operate in accordance with the method or subsequently outfitted with the device in accordance with the invention.

The method, when employed with a continuous solids-discharge centrifuge, will ensure the highest possible concentration of solids discharged from the nozzles and the lowest possible concentration of solids in the clarified phase even when the content of solids being fed in varies considerably. Separation is optimum with respect to the quality of both phases for a continuous solids-discharge centrifuge.

The apparatus for carrying out the method in accordance with the invention is distinguished by a diversion valve that is positioned in the discharge line leading from the centrifuge and that communicates through a recirculation line with the feed line leading into the centrifuge.

The apparatus also has a volume governor positioned in the feed line leading into the centrifuge downstream from where the recirculation line leads into the feed line. This volume governor maintains the volume of liquid being fed into the centrifuge at a constant level, decreasing the volume of new liquid by an amount equal to that of the recirculating clarified phase.

BRIEF DESCRIPTION OF THE DRAWINGS

The invention will now be described with reference to the drawing, which illustrates in schematic form one embodiment of the invention by way of example.

DETAILED DESCRIPTION OF THE INVENTION

The liquid to be separated is fed into a centrifuge 3 through a feed line 1 and a volume governor 2. The concentrated solids leave centrifuge 3 through a solids discharge 4. The clarified phase is discharged from centrifuge 3 through a liquids discharge 5, past a photocell 6, and through a diversion valve 7. When the turbidity of the clarified phase exceeds the level recognized as normal by photocell 6, controls 8 activate diversion valve 7, which diverts the clarified phase back to feed line 1 through recirculation line 9 until the level of turbidity decreases and possibly until a timing device, which is not illustrated, has completed its operation.

The solids discharge 4 is by way of nozzles (not shown). The cross-section of the nozzles in the centrifuge is dimensioned to ensure that the volume of solids discharged from them is smaller than the volume of solids fed into the centrifuge through the feed line. The solids space in the centrifuge accordingly fills up gradually and, when it is full, the clarified phase begins to get turbid. The level of turbidity is determined by photocell 6 and the flow of clarified phase returned to the feed line 1 through diversion valve 7. Since the amount of liquid being fed into the centrifuge is maintained at a constant level, the volume of new liquid flowing into the centrifuge is decreased by an amount equal to the volume of clarified phase being recirculated. The volume of solids being fed into the centrifuge then decreases to below the level of the volume of solids that can be discharged from the nozzles until the solids retained in the drum are discharged with the maximum concentration of solids discharged from the nozzles being maintained. Once the level of turbidity decreases, the recirculation of the clarified phase is, preferably after a certain delay, terminated. This ensures a constant maximum concentration of solids discharge and optimum clarification of the liquid phase at minimum automatic-control costs.

Other means, like a volumetric pump, of maintaining the volume of liquid being fed into the centrifuge at a constant level can be employed instead of volume governor 2. If a volumetric pump is employed, the clarified phase will be recirculated through the suction line.

The method described herein can of course also be employed with centrifuges that in addition to discharging the solids continuously also have means of discharging them discontinuously. Combinations of solids discharge by recirculation of the clarified phase and by discontinuous expulsion upon detection of turbidity are possible and the effective throughput of the centrifuge will be increased.

It will be appreciated that the instant specification and claims are set forth by way of illustration and not limitation, and that various modifications and changes may be made without departing from the spirit and scope of the present invention.

What is claimed is:

1. A method of optimizing the clarified phase and the concentration of solids in a continuous solids-discharge centrifuge comprising: maintaining the volume of liquid fed into the centrifuge at a constant level from a feed line; controlling the volume of solids discharged from the centrifuge to be smaller than the minimum volume of solids in the feed line; monitoring the turbidity of the clarified phase discharged from the centrifuge; and returning the clarified phase to the feed line when the turbidity of the clarified phase is greater than a predetermined value.

2. The method as in claim 1, wherein the length of time during which the clarified phase is returned is predetermined.

3. In a continuous solids-discharge centrifuge having a liquid feed line, a solids discharge and a liquid discharge, an apparatus for optimizing the clarified phase and the concentration of solids comprising: means for maintaining the volume of liquid, fed into the centrifuge from the feed line, at a constant level; means for controlling volume of solids discharged from the solids discharge to be smaller than the minimum solids volume in the feed line; means for monitoring the turbidity of the clarified liquid in the liquid discharge; and means for returning liquid from liquid discharge to the feed line when the turbidity of the clarified liquid is greater than a predetermined value.

4. The apparatus according to claim 3 wherein the returning means comprises a diversion valve positioned in the liquid discharge from the centrifuge and which communicates through a recirculation line with the feed line leading into the centrifuge.

5. The apparatus according to claim 3 wherein the maintaining means comprises a volume governor positioned in the feed line downstream from where the recirculation line leads into the feed line.

* * * * *